United States Patent [19]

Phillips et al.

[11] 4,036,175

[45] July 19, 1977

[54] HIGH SPEED DEVELOPMENT TECHNIQUE

[75] Inventors: Edwin R. Phillips, Rosemont; Raymond J. Stankiewicz, Philadelphia, both of Pa.

[73] Assignee: Sperry Rand Corporation, New York, N.Y.

[21] Appl. No.: 671,794

[22] Filed: Mar. 30, 1976

[51] Int. Cl.[2] ..... G03G 15/08

[52] U.S. Cl. ..... 118/651; 118/653; 355/3 DD

[58] Field of Search ..... 118/637, 647, 651, 653, 118/656, 657; 427/21; 355/3 DD

[56] References Cited

U.S. PATENT DOCUMENTS

| | | | |
|---|---|---|---|
| 3,405,682 | 10/1968 | King et al. | 118/637 |
| 3,929,098 | 12/1975 | Liebman | 118/637 |
| 3,941,084 | 3/1976 | Kurita | 427/21 |
| 3,965,862 | 6/1976 | Yang | 118/637 |

*Primary Examiner*—Henry S. Jaudon

*Attorney, Agent, or Firm*—Alfred Stapler; Eugene T. Battjer

[57] ABSTRACT

To develop a latent image, which exists in the form of different potential values on different areas of a substrate, an auxiliary substrate is coated with toner by charging the toner triboelectrically and applying a potential to propel the charged toner onto the auxiliary substrate. This toner-coated substrate is brought into close proximity with the image forming substrate, while being maintained at a potential which lies between the different potential values of the latent image.

23 Claims, 1 Drawing Figure

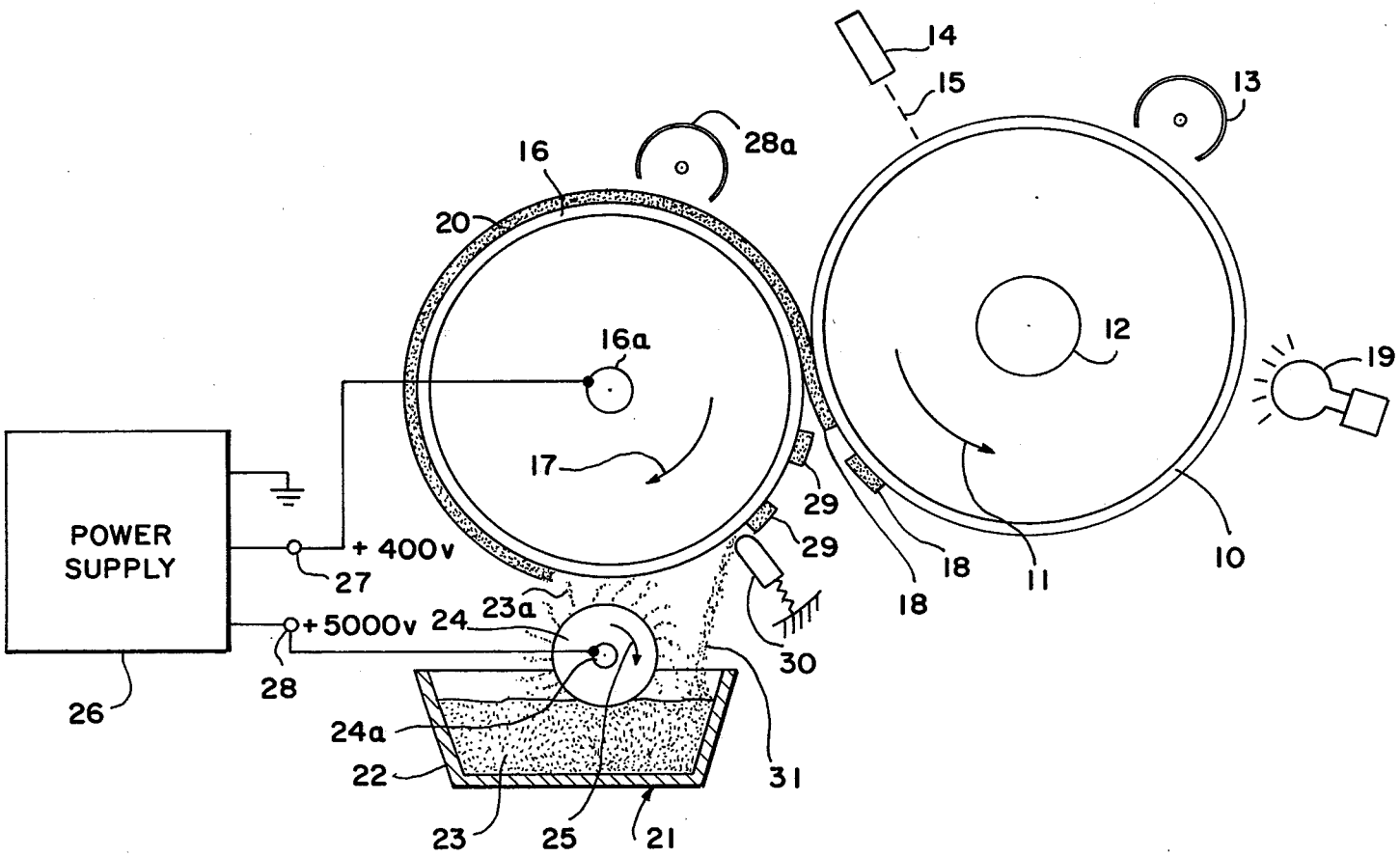
19
13
10
12
11
14
15
18
18
29
29
30
31
28a
21
16a
25
16
17
23a
23
20
24
+ 400v
+5000v
24a
22
27
28
POWER SUPPLY
26

HIGH SPEED DEVELOPMENT TECHNIQUE

This invention relates to improvements in image formation through electrodeposition of charged particles, and particularly to such improvements which enhance the rapidity with which such image formation can be accomplished.

The most widely used technique of image formation through electrodeposition is electrophotography or, as it is commonly referred to, xerography.

In xerography, a pattern of distinctively charged areas representing the image is produced on a semi-conductor surface. This surface (which is usually in the form of a rotating photoconductor drum) is coated with pigmented, charged particles (the so-called toner) which adhere to the drum preferentially in the image representative areas. The toner pattern is then transferred to paper which is brought into contact with the toner-coated drum, thereby reconstituting a copy of the original image on the paper.

It is notorious that this technique has been eminently successful, notably in office copiers, which have gained extremely widespread acceptance.

However, this technique has also been subject to significant limitations. In particular, the speed with which any given image area can be reproduced by means of this technique has left much to be desired. This speed is normally expressed in linear units representing the length of the copy being produced, the width being simply the dimension of the copy paper transverse to the direction of paper movement.

Speeds as high as 20 inches per second have already been achieved. Judging by commercial acceptance, these are satisfactory for office copiers. However, such speeds have been obtained only by the use of equipment which was complex, costly, and difficult and expensive to maintain. Moreover, for applications of the technique to output printers for computers, or for other high speed applications, speeds even higher than the figure given above would not be excessive.

One of the most important factors limiting the speed of xerographic machines has been the problem of forming a relatively uniform and thick layer of toner particles on the desired portions of the image bearing photoconductor drum. This is the phase of the process commonly referred to as "development".

Various development techniques have been proposed. One of the most elementary involves cascading a triboelectrically charged mixture of toner and glass beads over the rotating drum and relying on the electrostatic field of the image on the photoconductor drum to cause the desired portions of toner layer to form. This technique turns out to be incapable of forming an image with the desired characteristics, except at compartively low linear speeds, of the order of 4 or 5 inches per second.

A different development technique utilizes a so-called magnetic brush to apply the toner from a reservoir to the rotating photoconductor drum. Such a magnetic brush uses a rotating cylinder to magnetically pick up magnetic (e.g. iron) particles contained in a storage bin in mixture with the toner particles. This forms thread-like protrusions from the cylinder, resembling the bristles of a brush, which are attached to the cylinder by the magnetic forces acting on the iron particles.

The iron particles are coated with a polymer, so related in the triboelectric series to the toner material that the latter becomes electrically charged by the intermixing action with the iron particles which takes place in the bin.

This rotating magnetic brush transports the charged particles into engagement with the image-forming drum, whereby a toner coating on selected areas of that drum is produced. However, the speed of operation is again low. The difficulty is mainly that of building up a sufficient charge on the particles to obtain large-scale transfer to the drum, especially at high drum speeds. This would entail such vigorous agitating of the mixture in the storage bin, in order to effect enough charging through the triboelectric effect, that the polymer, coating on the iron particles would wear out prematurely. Since these coated iron particles constitute one of the most costly ingredients of this technique, the economics become unattractive.

A somewhat different approach to development entails applying the toner coating not directly to the semiconductor drum upon which the image representative charge pattern is formed, but rather to an auxiliary substrate, which does not have such an image pattern on it. This coated auxiliary substrate is then brought into close proximity to the image forming surface, to which the toner transfers in the desired areas.

Usually, the auxiliary surface is also a drum, counter-rotating with the image-forming drum at the same linear speed, and tangential to the latter. This technique is sometimes referred to as "impression development".

One advantage of impression development is that there is little, if any, peripheral sliding movement between the toner and the image forming drum in the toner transfer regions. This results in less wiping, or smearing of the reproduced copy which, in turn, makes possible higher ultimate copy resolution at a given speed, or higher speed without sacrificing resolution.

However, impression development, as heretofore practiced, has still by no means been entirely satisfactory. One serious disadvantage has been that the surface of the auxiliary drum has been subjected to severe wear. This surface has been constructed to have quite special characteristics. It has had to be made of material which partakes of both conductive and insulating properties, i.e., a semi-conductor. Moreover, this material has had to be triboelectrically remote from the toner. This causes charging of the toner, after being placed on the surface of the auxiliary drum, under the influence of doctor blades which ride on that surface and produce charge-generating rubbing of the toner, at the same time that they distribute the toner in a layer of comparatively uniform thickness on the surface.

The need for these special properties has led to an auxiliary drum construction which has inherently limited life, leading to high costs.

Moreover, the rubbing action which has been relied upon for toner charging causes wear of the auxiliary drum surface. This disadvantage becomes more and more accentuated as the speed of operation is increased. Not only does such wear reduce the service life of the auxiliary drum, but it also tends to occur unevenly, leading to scratches and grooves in its surface. These, in turn, cause non-uniformities in the charged toner coating, which manifest themselves as visible imperfections in the ultimately produced copy.

Accordingly, it is an object of this invention to provide an improved development technique.

It is another object to provide such a technique, which is free from one or more of the disadvantage of the prior art noted above.

It is another object to provide such an improved development technique which is capable of providing a highspeed xerographic copying system.

It is another object to provide such an improved technique by means of which the life of certain elements of the system is extended.

It is another object to provide such an improved technique by means of which equipment wear is reduced.

It is another object to provide such an improved technique by which equipment cost is reduced, without sacrifice of speed.

These and other objects which will appear are achieved, in accordance with the invention, by providing an auxiliary substrate, on which to form a uniform coating of toner, which is of simple, durable and inexpensive construction. The coating is applied to this auxiliary substrate in a manner to produce a highly charged, thick layer, even at high linear speeds of the auxiliary substrate. The toner application is carried out by a device which is also of simple, durable and inexpensive construction.

In a preferred form of the invention, the auxiliary substrate is a web of stainless steel, shaped into a drum. A magnetic brush is used to apply the coating of toner to the stainless steel drum.

The mixture of toner and iron particles for the magnetic brush is so chosen as to be much richer in toner than had heretofore been customary.

A high electric potential difference, externally developed, is applied between the metal roller of the magnetic brush and the stainless steel drum, with such polarity as to create a strong electric force propelling the toner from the brush roller toward the drum and contributing to the deposition of copious quantities of toner on the drum.

The coating of toner so formed on the stainless steel drum is selectively transferred to the desired portions of the image forming photoconductive drum by tangentially counterrotating the two drums. An externally developed potential is also applied to the stainless steel drum, so chosen that the potential of the charged toner layer on that drum lies between the potential values of the photoconductor drum which characterize the light and dark-representative portions of the latter, respectively.

For further details, reference is made to the description which follows, in the light of the accompanying drawings, wherein the single FIGURE is a diagrammatic illustration of a preferred embodiment of apparatus for practicing the invention.

Referring now to the drawing, this shows, all in highly diagrammatic form and not to scale, a drum 10 rotating in the direction indicated by arrow 11 about a shaft 12. Drum 10 represents what is essentially a conventional constituent of a xerographic image reproducing system. The drum itself may be of entirely conventional construction, with a photoconductor surface which is charged, as for example by electrostatic charging device 13, which may be in the form of a well known "Corotron." After passing beneath this charging device 13, the surface of the photoconductor drum 10 may be at a potential of, for example, plus 800 volts. The surface so charged, next passes beneath illuminating device 14 which, again, may take any one of a number of conventional forms. For example, in high speed applications of the system, it may take the form of a laser which projects a beam 15 upon the surface of the photoconductor drum 10. This beam is caused to scan transversely to the circumference of the drum as, for example, by a suitable rotating mirror arrangement, and is electronically controlled to form on the surface of the rotating photoconductor drum 10 a pattern of light corresponding to the image to be reproduced. The use of a laser makes it possible to trace such an image pattern with high resolution and at high rotating speeds of the drum. Also the laser causes a comparatively intense light to illuminate the desired portions of the photoconductor surface, thereby causing a strong response in these portions even at high rotating speeds of the drum 10. In all respects, therefore, a laser is especially suitable for use with a high speed reproducing system. It will be understood, however, that other means for projecting light images on the surface of the drum 10 may be used.

A laser is particularly useful when the system is used as the "printer" reproducing alphanumeric characters representing the output of a computer. In such application, the scanning laser beam 15 traces the desired pattern of such characters on drum 10. These characters than ultimately appear on computer print-out paper, as more fully explained below.

The illumination of particular portions of the surface of drum 10 causes the discharge of these portions so that, after passage of any given drum portion below the illumination provided by element 14, there will be certain areas of the drum which, by virtue of not having been illuminated, will still be charged to approximately plus 800 volts, while other areas, namely those which have been illuminated, will have been brought to a considerably lower potential, e.g. about plus 50 volts.

The drum 10, with its photoconductor surface thus patterned with areas at different potentials, next passes in close tangential proximity to another drum 16, counter-rotating in the direction indicated by arrow 17. In a manner which is discussed in more detail hereafter, there are transferred to the surface of drum 10 in this tangential region between drums 10 and 15, portions 18 of toner in those areas of the surface of drum 10 whose potential has been reduced from the value produced by charging device 13 through the action of light beam 15. In other words, the surface areas of drum 10 occupied by toner portions 18 are those which are at a potential value of about plus 50 volts. Those areas of the surface of drum 10 which remain at plus 800 volts (not having been illuminated) do not have toner portions 18 transferred to them.

The toner portions 18 on the surface of drum 10 are transferred in the course of continuing rotation of the drum, to the final copy medium, such as paper. This transfer may take place in any conventional manner, as may the subsequent processing of the paper, and these steps are therefore not further described here.

The drum 10 then passes beneath lamp 19, which illuminates a swath across the entire drum, thereby bringing the entire drum surface which it illuminates to about plus 50 volts. This, in effect, erases the image formed on drum 10. The process is then ready to be repeated.

The drum 16, from which toner portions 18 are transferred to drum 10, preferably is formed of a stainless steel band positioned to conform to drum shape.

A coating 20 of toner is formed on this drum 16 in the following manner. A magnetic brush 21 which, in itself, may be of conventional construction (except as noted below) is positioned generally below drum 16. This magnetic brush 21 includes a container 22 within which is placed a mixture of magnetic particles, e.g. iron particles coated with polymer, if appropriate, and of toner particles. A metal roller 24 rotates in the direction of arrow 25. Magnetizing means (not shown in FIG. 1) are provided to produce a magnetic field extending beyond roller 24. The well known effect of this is to form bristle-like extensions 23*a* protruding from the surface of roller 24. These extensions consist of magnetic particles held to the surface of the roller by the magnetic field and these magnetic particles in turn are coated with toner particles. The rotating cylinder 24 is positioned close enough to drum 16 so that the bristles 23*a* reach the surface of drum 16 at their points of closest approach to the latter.

As is conventional in magnetic brushes, the materials used in the mixture are so chosen that the mixing and agitating action between the two kinds of particles in mixture 23 creates a charge on the toner by virtue of the triboelectric effect. Preferably, these relationships are so chosen that a charge of, say, plus 100 volts is developed on the toner particles.

In addition, and this represents a departure from conventional arrangements, there is provided an electric power supply 26, which may be of any conventional construction capable of providing two outputs 27 and 28. At output 27 there is produced a positive potential of, say plus 400 volts, and at output 28 a much higher positive potential of, say, plus 5000 volts. The output 27 is connected to drum 16, while output 28 is connected to roller 24.

These connections may be made in any conventional manner as, for example, by means of sliding (slip ring) connections to the shafts 16*a* and 24*a* on which drum 16 and roller 24 respectively rotate. These shafts in turn are electrically connected to the respective surfaces of drum and roller.

This apparatus creates an interplay of forces which propel the toner particles strongly from roller 24 toward drum 16, thereby forming toner coating 20 on that drum. In particular, it is believed that the toner particles, electrically charged by the triboelectric effect of magnetic brush 21 to a positive potential, are strongly repelled from roller 24 toward drum 16 by the additional potential difference imposed by connections 27 and 28. In other words, power supply 26 sets up between roller 24 and drum 16 an electric field whose orientation is such that the toner particles are displaced toward and into intimate contact with drum 16. There they build up the desired coating 20. Due to the strong forces which are involved, this coating is capable of becoming adequately thick, even though drum 16 rotates at higher speeds than had previously been considered practical.

If desired, the potential of toner coating 20 may be further raised by electrostatic charging device 28*a,* which may be in the form of a Corotron. Such a device 28*a* would be positioned along the circumference of drum 16 past magnetic brush 21, but before the toner coating reaches the region of tangential proximity to drum 10. When the coating 20 of toner on drum 16 does reach that region of tangential proximity to drum 10 it will experience the forces exerted by the potential values of the different areas of its surface. It will be recalled that some of these surface areas of drum 10 are at approximately plus 50 volts. As more fully explained hereafter, those surface areas of drum 10 which are at plus 50 volts will exert an attacting effect on adjacent areas of toner coating 20. Consequently, toner from layer 20 will transfer into engagement with the surface of drum 10 in these areas of drum 10, namely those at approximately plus 50 volts. On the other hand, toner will not be transferred to those areas of drum 10 which are at approximately plus 800 volts. The transferred toner portions 18 remain on drum 10 as the latter continues to rotate. On drum 16, there will remain untransferred toner portions 29.

Toner portions 29 remaining upon drum 16 will then be subjected to the action of a soft wiper blade 30, which may, for example, be formed of comparatively soft plastic foam, and which is pressed lightly against the surface of drum 16. The rubbing action of this wiper blade 30 causes removal of at least the topmost portions of the toner still present on the surface of drum 16. The portions so removed are shown at 31, returning by gravity into container 22, where they again become part of mixture 23.

The system shown in the drawing and described above can be operated with drum 10 rotating at substantially higher linear speeds than was the case for the image forming drum in prior systems, including prior systems using impression development.

In accordance with the invention, magnetic brush 21 can be operated in a manner which causes it to transfer to drum 16 a larger quantity of toner than had previously been considered practical. This is due to the fact that the triboelectric effect is no longer the principal mechanism for producing the desired transfer from brush to drum. Rather, the triboelectric effect is relied upon to produce only a comparatively slight charge on the toner particles. An additional, strong transfer force is created by the potential difference established between drum 16 and roller 24, as previously discussed. Since only slight triboelectric charging is required, it becomes possible to use a mixture 23 in brush 21 which is richer in toner than the conventional mixtures. For example, in magnetic brushes a mixture having about 1% of toner by weight is conventional. In accordance with the present invention, a mixture of toner and iron particles may be used in which the toner amounts to 2 or even 3% by weight. This results in the transfer of more toner by a magnetic brush rotating at a given rate. Alternatively the rate of rotation of the brush can be increased, thereby likewise increasing the amount of toner transferred by the brush.

In the region of tangential proximity between drums 16 and 10, there also manifests itself an effect which is conductive to high speed operation of the system. As has been discussed, the potential applied to drum 16 from power supply connection 27 brings that drum to a potential which is intermediate the two different potential values which the surface of drum 10 is capable of assuming. This creates an electric field between drums 16 and 10 in the region in which these drums are in tangential proximity to each other. This field will have one orientation, for areas of drum 10 which are at the lower of the two potential values which drum 10 is capable of assuming. It will have the opposite orientation for areas of drum 10 which are at the higher of these values.

When positively charged toner coating 20 now is introduced, through rotation of drum 16, into this region of tangential proximity of the drums, there takes place what might be characterized as a "switching" action.

Those portions of this positively charged toner coating 20 which become juxtaposed with areas of drum 10 at the lower potential are subject to a field whose orientation propels them from drum 16 and onto drum 10 (where they then form toner portions 18).

On the other hand, those portions of toner coating 20 which become juxtaposed with areas of drum 10 at the higher potential are subject to an oppositely oriented field keeping them on drum 16 (as toner portions 29).

This definite switching action makes it possible to operate the two drum at higher speeds, without detracting from the reliability of the selective transfer process. Alternatively, it makes possible finer resolution of the reproduced image, without loss of speed, or a trade-off between these two improved characteristics.

Preferably, the two drums 16 and 10 are brought as close to each other as practical, in this region of tangential proximity. The closer they are, the stronger the switching action. However, enough space must be left to permit the coating 20 to pass between them, and also to prevent arcing from the potential difference between them.

The fact that drum 16 is not made of semiconductor material, but rather of a material such as stainless steel, has the advantage that it is not only comparatively inexpensive, but also much less subject to possible surface wear or damage.

Wiper blade 30 serves to remove at least the uppermost layer of the coating portions 29 which remain on drum 16. It also produces a certain amount of intermixing of toner within any remnants of these toner portions which are not actually removed by the wiper blade. This intermixing prevents stratification of charge within this residual toner on drum 16, which might otherwise occur as successive coatings of toner are built up during successive revolutions of drum 16.

The stainless steel of drum 16 is preferably in the form of a tightly woven mesh. This gives drum 16 a degree of surface irregularity which is helpful in retaining toner on that surface in an essentially continuous, thick coating.

Instead of mesh, the surface of drum 16 may be formed of a solid sheet of metal such as stainless steel or berrylium copper, into which are etched tiny grooves, e.g. about 4 mils wide.

Care should be taken to butt join the ends of this stainless steel web, so that there is no change in surface level at the joint, as there might be if an overlapping joint were used. Such a change in level could lead to striation in the reproduced image and should therefore be avoided.

Also, it may be desirable to provide, beneath the web which forms the surface of drum 16, a layer of a material such as resilient plastic foam, to provide some degree of compliance for accommodating surface irregularities of the drum.

In the system shown in the drawing, it is on those areas of drum 10 which have been illuminated (by scanning laser beam 15) that the image representative toner portions 18 are ultimately formed. This is appropriate when the system is used as a "printer", as previously explained. It would not be appropriate if the system were to be used as a "copier", in the manner of a conventional office copying machine.

In a copier application, it would normally be desired that the image representative toner portion 18 be formed on those areas of drum 10 which had not been illuminated during exposure to the image to be copied.

In a system embodying the invention, this can readily be accommodated by reversing the polarity of the charge which is developed on toner coating 20 by the triboelectric effects of magnetic brush 21.

It will be seen that, if coating 20 were charged negatively, the switching action between drums 16 and 10 would become such that toner portions 18 would form on the higher potential (non-illuminated) areas of drum 10, while the lower potential (illuminated) areas of drum 10 would not have toner deposited on them.

This polarity reversal of the toner charge can be accomplished by suitable selection in known manner of the materials being mixed in drum 22.

Along with this change in toner charge polarity, there would also have to be a change in the potential produced at output 28, relative to that at output 27, so that there is again developed a strong electric field acting in the direction to propel the toner from roller 24 onto drum 16. For example, this potential at output 28 may now be minus 4200 volts. This gives the same magnitude of potential difference (and field strength) as before, but with opposite polarity (i.e., opposite field orientation).

Various other modifications will occur to those skilled in the art without departing from the inventive concept.

We claim:

1. In a system for developing images utilizing the deposition of toner on selected portions of an image forming substrate which are caused to assume values of electric potential distinctively different from those of other portions of the image forming substrate, said system including an auxiliary substrate, means for applying to the auxiliary substrate a coating of the toner having an electric charge of a predetermined polarity, and means for bringing the coated auxiliary substrate into close proximity to the image forming substrate for transfer of toner to the selected portions of the image forming substrate, the improvement which comprises:

means for establishing, between the auxiliary substrate and the coating applying means, a potential difference of such polarity as to propel the charged toner away from the applying means and toward the auxiliary substrate, and at least the surface of the auxiliary substrate which is coated with the toner being made of a metal conductor.

2. The system of claim 1, wherein metal is a highly wear resistant metal.

3. The system of claim 1, wherein the metal is stainless steel.

4. The system of claim 3, wherein the surface has small irregularities.

5. The system of claim 4, wherein the surface is of woven stainless steel.

6. The system of claim 4, wherein the surface has grooves.

7. The system of claim 1, wherein the potential difference between auxiliary substrate and coating applying means is substantially greater than the potential of the coating corresponding to the electric charge on the toner.

8. The system of claim 7, wherein the potential difference between auxiliary substrate and coating applying means is several times the toner charge potential.

9. The system of claim 1, further comprising means for maintaining the auxiliary substrate at a substantially constant potential.

10. The system of claim 9, wherein the potential at which the auxiliary substrate is maintained is intermediate the potential values of the selected portions of the image forming substrate and the potential values of the other portions of the last-named substrate.

11. The system of claim 10, wherein each substrate is a drum, the two drums being counterrotating, and positioned to have regions of tangential proximity in which the transfer of toner from the auxiliary substrate drum to the image forming substrate drum takes place.

12. The system of claim 11, wherein the means for applying the toner to the auxiliary substrate drum is a magnetic brush means.

13. The system of claim 12, wherein the potential difference establishing means is connected to the magnetic brush means and to the auxiliary substrate drum.

14. The system of claim 13, wherein the magnetic brush includes a reservoir holding a mixture of particles of magnetic material and particles of toner, the toner being present in the mixture in proportions substantially in excess of one percent by weight.

15. The system of claim 14, wherein the electric charge on the toner applied to the auxiliary drum is produced by triboelectric interaction between the particles in the reservoir.

16. The system of claim 13, further comprising means for applying to the toner coating on the auxiliary drum additional electric charge of the same polarity as applied by the magnetic brush before the toner coating on the auxiliary drum reaches the region of tangential proximity to the image forming drum.

17. The system of claim 13, further comprising means for removing from the auxiliary drum at least a portion of the coating remaining on the drum after passing the region of tangential proximity with the image forming drum.

18. The system of claim 17, wherein the removing means is a foam wiper blade which also agitates the remainder of the coating that is not removed.

19. The system of claim 1, wherein the image forming substrate is a photoconductor drum as employed in xerographic image reproduction.

20. The system of claim 19, wherein the selected portions of the photoconductor drum are caused to assume their distinctive potential values by laser scanning.

21. The system of claim 1, wherein the toner is to be deposited on portions of the image forming substrate at the lower of its different potential values, and further characterized in that the toner is charged with the same polarity as the image forming substrate.

22. The system of claim 1, wherein the toner is to be deposited on portions of the image forming substrate at the higher of its different potential values, and further characterized in that the toner is charged with a polarity opposite to that of the image forming substrate.

23. In a system for developing images utilizing the deposition of toner on selected portions of an image forming substrate, said system including an auxiliary substrate, means for applying to the auxiliary substrate a coating of the toner having an eletric charge of a predetermined polarity, and means for bringing the coated auxiliary substrate into close proximity to the image forming substrate for transfer of toner to the selected portions of the image forming substrate, the improvement which comprises:

means for establishing, between the auxiliary substrate and the coating applying means, a potential difference of such polarity as to propel the charged toner away from the applying means and toward the auxiliary substrate, and at least the surface of the auxiliary substrate which is coated with the toner being made of a metal conductor.

* * * * *